US005649790A

United States Patent [19]

Mergen et al.

[11] Patent Number: 5,649,790

[45] Date of Patent: Jul. 22, 1997

[54] FRICTION ROCK STABILIZER AND METHOD FOR INSERTION

[76] Inventors: Douglas Matthew Mergen, P. O. Box 331, Deadwood, S. Dak. 57732; Dean Allen Vilhauer, 8920 Ridge Trail, Sturgis, S. Dak. 57785

[21] Appl. No.: 493,787

[22] Filed: Jun. 22, 1995

[51] Int. Cl.[6] ..... E02D 27/50; E21D 20/00; E21D 21/00

[52] U.S. Cl. ..... 405/259.3; 405/244; 405/259.1

[58] Field of Search ..... 405/259.3, 233, 405/259.1, 244; 411/512, 513, 514, 516, 520

[56] References Cited

U.S. PATENT DOCUMENTS

| | | | |
|---|---|---|---|
| Re. 28,227 | 11/1974 | Elders | 411/439 |
| 3,349,567 | 10/1967 | Munn | 405/259.3 |
| 3,922,867 | 12/1975 | Scott | 411/61 |
| 4,012,913 | 3/1977 | Scott | 411/479 |
| 4,126,004 | 11/1978 | Lindeboom | 405/259 |
| 4,313,695 | 2/1982 | McCartney | 405/259 |
| 4,334,804 | 6/1982 | Lindeboom | 405/259 |
| 4,407,610 | 10/1983 | Elders | 405/259.3 |
| 4,445,808 | 5/1984 | Arya | 405/259 |
| 4,607,984 | 8/1986 | Cassidy | 405/261 |
| 4,666,345 | 5/1987 | Seegmiller | 405/259.1 X |
| 4,798,501 | 1/1989 | Spies | 405/260 |
| 4,954,017 | 9/1990 | Davis et al. | 405/259.3 |
| 4,971,493 | 11/1990 | Herbst et al. | 411/5 |
| 5,295,768 | 3/1994 | Buchhorn et al. | 405/259.3 |
| 5,387,060 | 2/1995 | Locotos | 405/259.3 X |

*Primary Examiner*—Tamara L. Graysay
*Assistant Examiner*—Tara L. Mayo
*Attorney, Agent, or Firm*—Salzman & Levy

[57] ABSTRACT

An apparatus for securing the rock formation of a structure, such as in the walls and ceiling of a mine shaft includes a forward portion having a given diameter and length and cross section and a larger diameter rear portion also having a given diameter and length and cross section. A tapered conical portion is attached between the forward portion and the rear portion thereby serving as a smooth interface therebetween. A slit, having a predetermined width gap, runs the full length of the apparatus and an annulus is provided that is attached to the rear portion to engage a mine shaft plate. To insert the apparatus into the formation, a first larger diameter hole is drilled into the formation approximately equal to or slightly in excess of the length of the rear portion. A second smaller diameter hole is then drilled along the same axis to an overall depth which equally or exceeds the length of the apparatus. The mine shaft plate is then placed over the apparatus before it is inserted into the drilled holes. When resistance is encountered it is driven fully into the holes until the mine shaft plate bears upon the formation.

16 Claims, 2 Drawing Sheets

FRICTION ROCK STABILIZER AND METHOD FOR INSERTION

BACKGROUND OF THE INVENTION

1. Field of the Invention

The present invention, in general, relates to devices for anchoring of a structure such as the wall or roof of a mine shaft or other opening and, more particularly, to such types of devices that rely upon frictional engagement between the device and the structure to accomplish the anchoring.

Friction rock stabilizers are also referred to in the mining industry as "bolts". They are in general known types of devices. As they are usually inserted into a bored hole by impact or by other force, such as by a hydraulic cylinder urging them into position, they generally require access to the head of the bolt in order to effectively drive them into the structure they are to reinforce (anchor).

Due to the nature of the structure to be anchored a longer type of a bolt is often required. However, the available clearances in mine shafts may preclude the use of a longer bolt where access to the head of the bolt is required. A greater quantity of smaller bolts, may in some instances be used, but this adds both to the time and expense to drill the bore holes and to then install the bolts.

In other instances a longer bolt is necessary to reach certain kinds of strata that are able to bear the weight and the load that is exerted by weaker strata disposed closer to the mine shaft. If the available room precludes such use, individual safety is compromised in these kinds of mine shafts or great difficulty and expense is incurred in an attempt to drive longer types of bolts in areas where clearances are tight.

What is considered a long or a short friction rock stabilizing bolt depends upon the particular circumstances. In certain instances a bolt of only a few feet in length is considered long where in another instance it would be regarded as being short. Similarly, a bolt of 8 feet in length or longer is commonly referred to as a long bolt but in another more unique situation it would be a short bolt.

Of course the disclosure as shown is adaptable for use with friction stabilizing bolts of any length and while situations may arise or be discovered where a bolt of only a few inches in length is useful to secure a structure, normally for most applications these bolts will range in length from a couple of feet long to slightly over 10 feet long.

Accordingly there exists today a need for a Friction Rock Stabilizer type of bolt that provides good anchoring characteristics that is also adapted for use in areas of low installation clearance.

Also these improved friction rock stabilizer bolts, as disclosed herein, have been found on occasion to provide greater retention strength for any given level of insertion force as compared to a conventional bolt of similar length and therefore they are also useful when a lower insertion force is preferred that nevertheless yields an acceptably high retention force.

2. Description of Prior Art

Friction Rock Stabilizer bolts are, in general, known. For example, the following patents describe various types of these devices:

U.S. Pat. No. RE 28, 227 to Elders, Nov. 5, 1974;

U.S. Pat. No. 3,349,567 to Munn, Oct. 31, 1967;

U.S. Pat. No. 3,922,867 to Scott, Dec. 2, 1975;

U.S. Pat. No. 4,012,913 to Scott, Mar. 22, 1977;

U.S. Pat. No. 4,126,004 to Lindeboom, Nov. 11, 1978;

U.S. Pat. No. 4,313,695 to McCartney, Feb. 2, 1982;

U.S. Pat. No. 4,334,804 to Lindeboom, Jun. 15, 1982;

U.S. Pat. No. 4,445,808 to Arya, May 1, 1984;

U.S. Pat. No. 4,607,984 to Cassidy, Aug. 26, 1986;

U.S. Pat. No. 4,798,501 to Spies, Jan. 17, 1989; and

U.S. Pat. No. 4,971,493 to Herbst, et al, Nov. 20, 1990.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an important object of the present invention to provide a friction rock stabilizer that is useful for inserting longer bolts in areas with limited clearance.

It is also an object of the invention to provide a friction rock stabilizer that provides high retention force for a given insertion force.

Another object of the invention is to provide a friction rock stabilizer that is easy to manufacture.

Still another object of the invention is to provide a friction rock stabilizer that is inexpensive to manufacture.

Yet another object of the invention is to provide a friction rock stabilizer that is compatible for use with conventional mine equipment, such as known types of mine roof plates.

Still yet another object of the invention is to provide a method for insertion thereof of the friction rock stabilizer into a rock or other structural formation.

Briefly, a friction rock stabilizer bolt that is constructed in accordance with the principles of the present invention has a hollow forward portion of predetermined length and cross section and diameter attached at a second end thereof to a first end of a hollow rear portion of predetermined length and cross section that has a greater diameter than does the forward portion and is disposed on the same longitudinal axis. A tapered conical portion is provided as the interface therebetween and a slit is provided the full length of the bolt from a first end of the forward portion to the second end of the rear portion. A method of engaging a mine plate, which in turn supports the formation structure, is provided at the second end of the rear portion. The method for insertion includes boring a first larger diameter hole a portion of the length of the bolt which exceeds the length of the rear portion. The first larger diameter hole is smaller in diameter than is the outside diameter of the rear portion. A second hole having a smaller diameter than the first larger hole is then drilled along the axis of the first hole to a length which exceeds the overall length of the friction rock stabilizer. The second hole is smaller in diameter than is the outside diameter of the forward portion. The bolt is then inserted into a mine roof plate until the mine roof plate bears against the formation. The bolt is then inserted into the drilled holes until resistance is first encountered. The bolt is then driven into the drilled holes by whatever means is preferred until the mine roof plate bears upon the formation thus securing the formation in place.

DETAILED DESCRIPTION OF THE INVENTION

Figure 1:
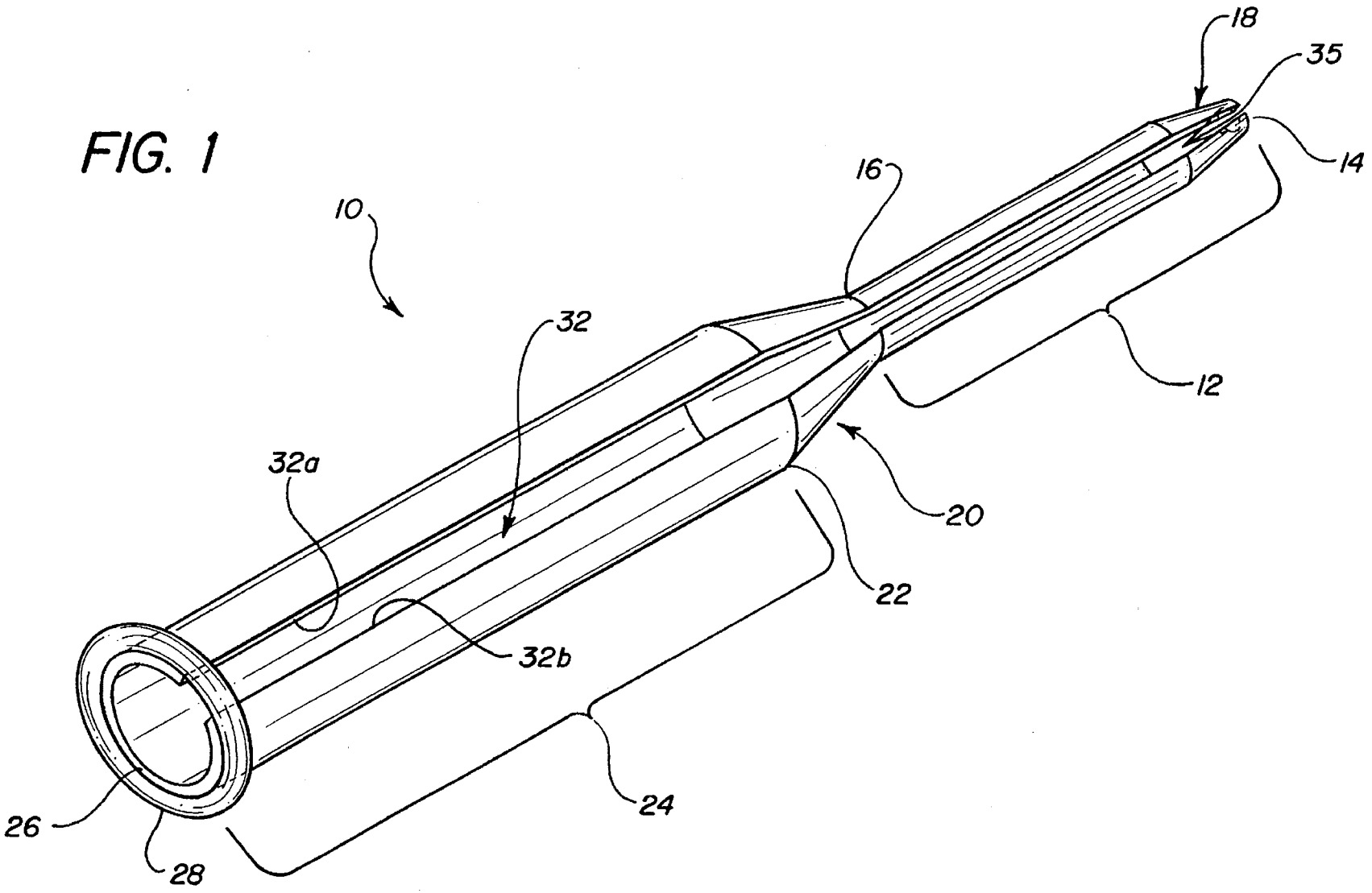
FIG. 1 is a view in perspective of the friction rock stabilizer bolt.

Referring to FIG. 1 and to FIG. 2 as required is shown, a friction rock stabilizer bolt, hereinafter referred to as "the bolt", identified in general by the reference numeral 10.

The bolt 10 includes a hollow cylindrical forward portion identified in general by the reference numeral 12. The forward portion 12 includes a first end 14 and a second end 16. Near the first end 14 is provided a tapered nose 18 as desired to assist in the insertion of the bolt.

The second end 16 is attached to a hollow tapered portion 20 which is conical in shape and which shares the same longitudinal axis as does the forward portion 12. The smaller end of the conically shaped tapered portion 20 is attached to the second end 16.

The larger end of the conically shaped tapered portion 20 is attached to a first rear portion end 22 of a hollow cylindrical rear portion, identified in general by the reference numeral 24. The rear portion 24 also shares the same longitudinal axis as does the forward portion 12. A second rear portion end 26 is disposed on the end of the rear portion 24 farthest away from the first rear portion end 22 thereof.

Figure 2:
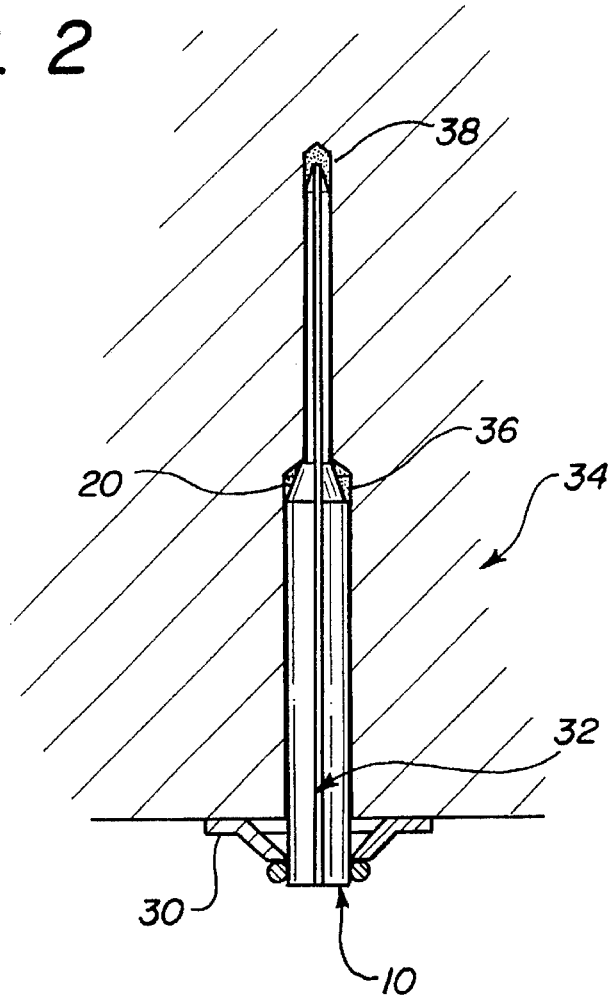
FIG. 2 is a side cross sectional view of the friction rock stabilizer in position in the formation it is to secure.

An annulus 28 is attached to the second rear portion end 26 as desired and is used to engage and apply force to a mine roof plate 30 (FIG. 2). Any preferred type of a mine roof plate 30 may be used including the type as is disclosed in U.S. Pat. No. 4,445,808.

A slit 32 having a predetermined width of gap between a pair of opposed faces 32*a*, 32*b* is provided along the full length of the bolt 10 from the first end 14 of the forward portion 12 to the second rear portion end 26 of the rear portion 24. When the bolt 10 is driven into a formation (Identified in general by the reference numeral 34 FIG. 2), the bolt 10 is compressed by the tension produced between the bolt 10 and the formation 34 which in turn causes the bolt 10 to compress in response to that tension thereby slightly decreasing the width of the slit 32.

The compression of the bolt 10 along the length of its body provides the necessary friction between the bolt 10 and the formation 34. The method of preparing the formation and of inserting the bolt 10 therein is discussed in greater detail hereinbelow. Accordingly the full length slit 32 is required for proper functioning of the bolt 10.

The tapered nose 18 is provided as desired to make insertion of the bolt 10 into the formation 34 easier. An optional opening 35 is provided in the tapered nose 18 on the side opposite with respect to the slit 32 to make insertion of the bolt 10 into the formation 34 even easier. The opening 35 is generally "V" shaped wherein the open end of the "V" is exposed at the first end 14 of the forward portion 12 and the closed end of the "V" is disposed in the tapered nose 18 at a predetermined distance away from the first end 14.

The opening 35 primarily aids in the insertion of the bolt 10 although it can, under certain special conditions such as when the tapered nose 18 of the bolt 10 is in contact with the formation 34, provide even greater retention of the bolt 10 in the formation 34.

The length and diameter of the forward portion 12, the tapered portion 20, and the rear portion 24 are varied depending upon the particular needs of the application. In general the forward portion 12 must be of small diameter than the rear portion 24.

For purpose of example, the dimension of the forward portion 12 of a typical bolt 10 has a diameter of approximately thirty-three millimeters and a length of approximately three feet. The rear portion 24 by way of example would similarly have a diameter of approximately 39 millimeters and a length of approximately five feet for an overall length of the bolt 10 of approximately eight feet. The tapered portion 20 must accommodate at each end thereof each diameter respectively to provide a smooth interface between the forward portion 12 and the rear portion 24.

The length of the tapered portion 20 is selected as desired and its length is usually subtracted from the length of either or both of the forward portion 12 and the rear portion 24 so as to maintain an overall bolt length of eight feet. An eight foot maximum length is preferred when low clearance mine shaft ceilings and widths do not allow for the length of the bolt 10 to be any longer than eight feet.

Of course if desired the length of the tapered portion 20 may be added as desired to any length of the forward portion 12 and the rear portion 24 so as to produce the bolt 10 as having a greater overall length than eight feet. Similarly the bolt 10 may include an overall length that is less than eight feet. Furthermore, the forward portion 12 and the rear portion 24 may each be of any desired length with respect to each other, depending upon the particular anchoring attributes of the formation to which they are to be used.

Referring now primarily to FIG. 2, it is shown that in order to prepare the formation 34 for insertion of the bolt 10, a first larger diameter hole 36 is drilled (bored) into the formation 34. To continue to use, by way of example, the preferred eight foot overall length of the bolt 10 as described hereinabove having the three foot long forward portion 12 and the five foot long rear portion 24, the first larger diameter hole 36 is drilled to a length of about 5 feet, or just slightly more, into the formation.

The first larger diameter hole 36 is smaller in diameter than is the outside diameter of the rear portion 24 by an amount selected to harmonize with the physical attributes of the formation 34 so as to produce the desire amount of friction between the bolt 10 and the formation 34.

A second smaller diameter hole 38 having a smaller diameter than that of the first larger diameter hole 36 is then drilled along the same axis as that of the first larger diameter hole 36 to an overall length that is slightly more than the overall length of the bolt, or in this case just over eight feet. This results in producing a second smaller diameter hole 38 having a length of approximately three feet sharing the same longitudinal axis as the first larger diameter hole 36 and being disposed adjacent with respect thereto.

The mine roof plate 30 is then properly oriented and placed over the bolt 10 starting at the first end 14 of the forward portion 12. The plate 30 is disposed along the bolt 10 until it makes contact with the annulus 28. The annulus 28 provides a method whereby the bolt 10 engages the mine plate 30. Other methods to allow the bolt 10 to engage the mine plate 30 in addition to the annulus 28, such as welding tabs (not shown) or other extensions (not shown) to the bolt 10, are now considered obvious after these teachings.

The bolt 10 is then inserted into the bored holes 36, 38 until resistance is encountered. In this example, the bolt 10 is inserted approximately three feet therein until the first rear portion end 22 of the rear portion 24 makes frictional contact with the beginning of the first larger hole 36. The bolt 10 is then driven into the holes 36, 38 the remainder of the distance (approximately 5 feet) until the annulus 28 is bearing upon the mine roof plate 30, which in turn is bearing upon the formation 34 with the desired force.

An advantage provided by the bolt 10 and method of insertion is that the bolt is only required, in the above example, to be driven five feet yet when fully inserted it is in frictional engagement with the formation 34 for the full overall length of the bolt 10 of eight feet.

Tests by the applicants have indicated that the bolt 10, for a given insertion force, provides a greater retention force than does a conventional split type of mine bolt (not shown) of the same overall length. Therefore not only does the bolt 10 provide for a shorter length of forced (driven) insertion into a formation 34, but it also can provide a greater retention strength for the maximum insertion force that is required to drive the bolt 10 fully into the formation 34.

Figure 3:
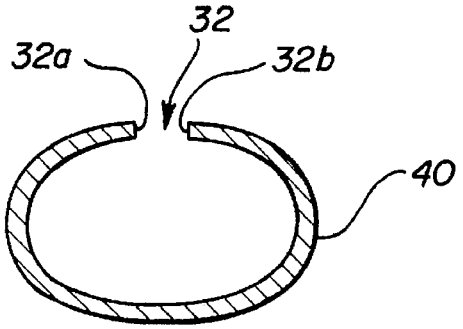
FIG. 3 is a cross sectional view of a section of a modified friction rock stabilizer.

Referring now to FIG. 3 a cross sectional view of a modified rear portion 40 is shown. The rest of the modified bolt is not shown and is identical to the bolt 10 described hereinabove except that instead of having the circular cross sectional attribute of the cylindrical bolt 10, the modified bolt has an elliptical cross section as shown. The slit 32 and the faces 32*a*, 32*b* are identical with that of the bolt 10. The modified bolt is useful for certain special applications and teaches that any cross section is possible.

Although steel is preferred any suitable material may be used for construction of the bolt 10. The forward portion 12, the rear portion 24, and the tapered portion 20 are preferably formed of the same material although they may be varied to accommodate very special types of formations 34.

When steel is used, the forward portion 12, the rear portion 24, and the tapered portion 20 are either welded together or are formed as a single piece by any of the preferred processes that are well known to metallurgy. When other materials are used they are attached by whatever method is preferred or formed by whatever process is preferred.

The invention has been shown, described and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A friction rock-stabilizer of extended length, having a tiered body, for insertion into a mine formation wherein the shaft space is generally limited to the insertion of short, friction rock-stabilizers, said extended-length, friction rock-stabilizer comprising:

a first, tubular, hollow section, having a tapered nose on a forward distal end thereof, and further comprising a rear portion, said first, tubular, hollow section having a first, outer diameter of a narrow, first gauge and having a length of at least several feet;

a second, tubular, hollow section, having a second, outer diameter of a second gauge that is substantially greater than said first, outer diameter of said first, tubular, hollow section, said second, tubular, hollow section having a forward, front portion extending from a third, intermediate, hollow, tapered section, and a rear, distal end;

a third, intermediate, hollow, tapered section, extending from said rear portion of said first, tubular, hollow section to the forward, front portion of said second, tubular, hollow section, thereby bridging said first and second tubular, hollow sections; and means defining a slit that substantially extends from said tapered nose of said first, tubular, hollow section to said rear, distal end of said second, tubular, hollow section.

2. The friction rock-stabilizer of extended length in accordance with claim 1, wherein said second, tubular, hollow section has a length of at least several feet.

3. The friction rock-stabilizer of extended length in accordance with claim 1, wherein said second, tubular, hollow section has a length that is longer than said first, tubular, hollow section.

4. The friction rock-stabilizer of extended length in accordance with claim 1, wherein said first and second tubular, hollow sections are substantially cylindrical in cross-section.

5. The friction rock-stabilizer of extended length in accordance with claim 1, wherein said second tubular, hollow section has a length that is approximately five feet.

6. The friction rock-stabilizer of extended length in accordance with claim 1, wherein said first, tubular, hollow section has a length that is approximately three feet.

7. The friction rock-stabilizer of extended length in accordance with claim 1, wherein said second, tubular, hollow section has an outer diameter of approximately thirty-nine millimeters.

8. The friction rock-stabilizer of extended length in accordance with claim 1, wherein said first, tubular, hollow section has an outer diameter of approximately thirty-three millimeters.

9. A friction rock-stabilizer of extended length, having a tiered body for insertion into a mine formation wherein the shaft space is generally limited to the insertion of short, friction rock-stabilizers, said extended-length, friction rock-stabilizer comprising:

a first, tubular, substantially cylindrical, hollow section, having a tapered nose on a forward, distal end thereof, and further comprising a rear portion, said first, tubular, substantially cylindrical, hollow section having a first, outer diameter of a narrow, first gauge and having a length of at least several feet;

a second, tubular, substantially cylindrical, hollow section, having a second, outer diameter of a second gauge that is substantially greater than said first, outer diameter of said first, tubular, substantially cylindrical, hollow section, said second, tubular, substantially cylindrical, hollow section having a forward, front portion extending from a third, intermediate, hollow, tapered, conical section, and a rear, distal end;

a third, intermediate, hollow, tapered, conical section, extending from said rear portion of said first, tubular, substantially cylindrical, hollow section to the forward, front portion of said second, tubular, substantially cylindrical, hollow section, thereby bridging the first and second tubular, substantially cylindrical, hollow sections; and means defining a slit that substantially extends from said tapered nose of the first, tubular, substantially cylindrical, hollow section to said rear, distal end of the second, substantially cylindrical, hollow tubular section.

10. The friction rock-stabilizer of extended length in accordance with claim 9, wherein the second, tubular, substantially cylindrical, hollow section has a length of at least several feet.

11. The friction rock-stabilizer of extended length in accordance with claim 9, wherein the second, tubular, substantially cylindrical, hollow section has a length that is longer than said first, tubular, substantially cylindrical, hollow section.

12. The friction rock-stabilizer of extended length in accordance with claim 9, wherein said first and second tubular, substantially cylindrical, hollow sections are substantially cylindrical in cross-section.

13. The friction rock-stabilizer of extended length in accordance with claim 9, wherein said second, tubular, substantially cylindrical, hollow section has a length that is approximately five feet.

14. The friction rock-stabilizer of extended length in accordance with claim 9, wherein said first, tubular, substantially cylindrical, hollow section has a length that is approximately three feet.

15. The friction rock-stabilizer of extended length in accordance with claim 9, wherein said second, tubular, substantially cylindrical, hollow section has an outer diameter of approximately thirty-nine millimeters.

16. The friction rock-stabilizer of extended length in accordance with claim 9, wherein said first, tubular, substantially cylindrical, hollow section has an outer diameter of approximately thirty-three millimeters.

* * * * *